US006044613A

United States Patent [19]

Crafts et al.

[11] Patent Number: 6,044,613

[45] Date of Patent: Apr. 4, 2000

[54] PATCHING DEVICE AND METHOD

[75] Inventors: Brian S. Crafts, 29 Lamplighter La., North Chelmsford, Mass. 01863; Kenneth H. Sears, Carlisle, Mass.

[73] Assignee: Brian S. Crafts, North Chelmsford, Mass.

[21] Appl. No.: 09/121,521

[22] Filed: Jul. 23, 1998

[51] Int. Cl.[7] ..... E04G 23/02

[52] U.S. Cl. ..... 52/741.1; 29/402.09; 52/514.5

[58] Field of Search ..... 52/514, 514.5, 52/741.4, 741.41, 741.1; 29/402.09, 897.1

[56] References Cited

U.S. PATENT DOCUMENTS

| | | | |
|---|---|---|---|
| 3,690,084 | 9/1972 | Leblanc | 52/514 |
| 3,936,988 | 2/1976 | Miceli | 52/514 |
| 3,999,347 | 12/1976 | Devlin | 52/514 |
| 4,075,809 | 2/1978 | Sirkin | 52/514 |
| 4,100,712 | 7/1978 | Hyman | 52/514 |
| 4,116,106 | 9/1978 | Barbour | 52/514 |
| 4,848,056 | 7/1989 | Kelly | 52/514 |
| 5,117,605 | 6/1992 | Waldbeiser | 52/514 |
| 5,269,114 | 12/1993 | Albers et al. | 52/514 |
| 5,875,606 | 3/1999 | Jensen | 52/514 |

*Primary Examiner*—Michael Safavi
*Attorney, Agent, or Firm*—Joseph Stecewycz

[57] ABSTRACT

A patching device suitable for use in the repair of a hollow structure which structure has a distal panel disposed from a proximal repair region. The patching device has a stem possessing a plurality of protrusions, and a collapsible plug comprising a central ring containing an axial opening to enclose the stem, and a locking hub to lock or tighten the plug against the proximal repair region. A plurality of flexible ribs extend from the central ring to the periphery of the plug. The plug has optional webs extending between adjacent ribs.

20 Claims, 10 Drawing Sheets

PATCHING DEVICE AND METHOD

BACKGROUND OF THE INVENTION

1. Field of the Invention

The present invention relates in general the repair of hollow structures, such as doors and walls, and in particular to a device and method for repairing holes in such structures.

2. Description of the Prior Art

The repair of a hole made in a hollow structure, such as doors and walls, generally consist of filling the repair volume with a spreadable compound which hardens after application. If the hole is relatively small, the filler compound readily adheres to the interior of the hole and is secured upon curing. However, if the hole is relatively large, it becomes impractical to simply fill in the hole because of the large amount of filler compound required and because the resulting weight of the filler compound may not be supported by adhesion of the cured repair material within the repair volume. In such applications a backup device, or plug, is used to provide a supporting structure, to which the compound can adhere, for emplacement across the repair opening.

The present state of the art discloses various repair devices for accomplishing this objective. Such devices commonly provide a disc-like patching component configured so as to cover over the repair area and provide for a surface upon which to apply patching material. The patching component, which may be rigid or somewhat flexible, is retained in position by one of various methods. U.S. Pat. No. 5,117,605, for example, discloses a rigid patching component held in place by means of a split washer disposed on a shaft spanning the interior of the repair region. U.S. Pat. Nos. 3,936,988 and 3,690,084 similarly disclose rigid patching components, but comprise compression springs to provide retention. By way of further example, U.S. Pat. No. 4,075,809 discloses a patching component which is partially flexible, and U.S. Pat. No. 4,100,712 discloses an aluminum patching component with partial radial slits to provide for some flexing and allow for entry of the component into the repair region.

As can be appreciated, certain of these design features increase the cost of fabrication, or may add to the complexity of construction, or may be difficult for the average consumer to use successfully. Furthermore, conventional patching components have little or no flexing capability, and this limits their application to repair openings of relatively large sizes.

The present state of the art indicates a need for an improved method of repairing walls.

It is an object of the present invention to provide a wall patch which is quick and simple for the average consumer to use.

It is yet another object of the present invention to provide such a wall patch which is relatively inexpensive to fabricate.

It is a further object of the present invention to provide such a wall patch which is suitable for use in repair holes of a relatively wide range of sizes.

Other objects of the invention will, in part, appear hereinafter and will, in part be apparent when the following detailed description is read in connection with the drawings.

SUMMARY OF THE INVENTION

These objects are achieved by a patching device comprising a flexible plug, a stem passing through an axial opening in the plug, and a locking hub with a ratcheting mechanism for engaging protrusions on the stem. The flexible plug is collapsible to allow insertion into a relatively small repair region. When the repair device is deployed within a damaged structure, the locking hub precludes the plug from flexing beyond a certain position, and the ratcheting feature serves to maintain the plug in position against the inside surface of the repair region.

Other objects of the present invention will in part be obvious and will in part appear hereinafter. The invention accordingly comprises the products, together with their component parts and methods of assembly that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE INVENTION

The following detailed description of the present invention is not to be taken in a limiting sense but is intended to illustrate the general principles of the invention. The scope of the invention is best defined by the appended claims.

Description of the Invention

Figure 1:
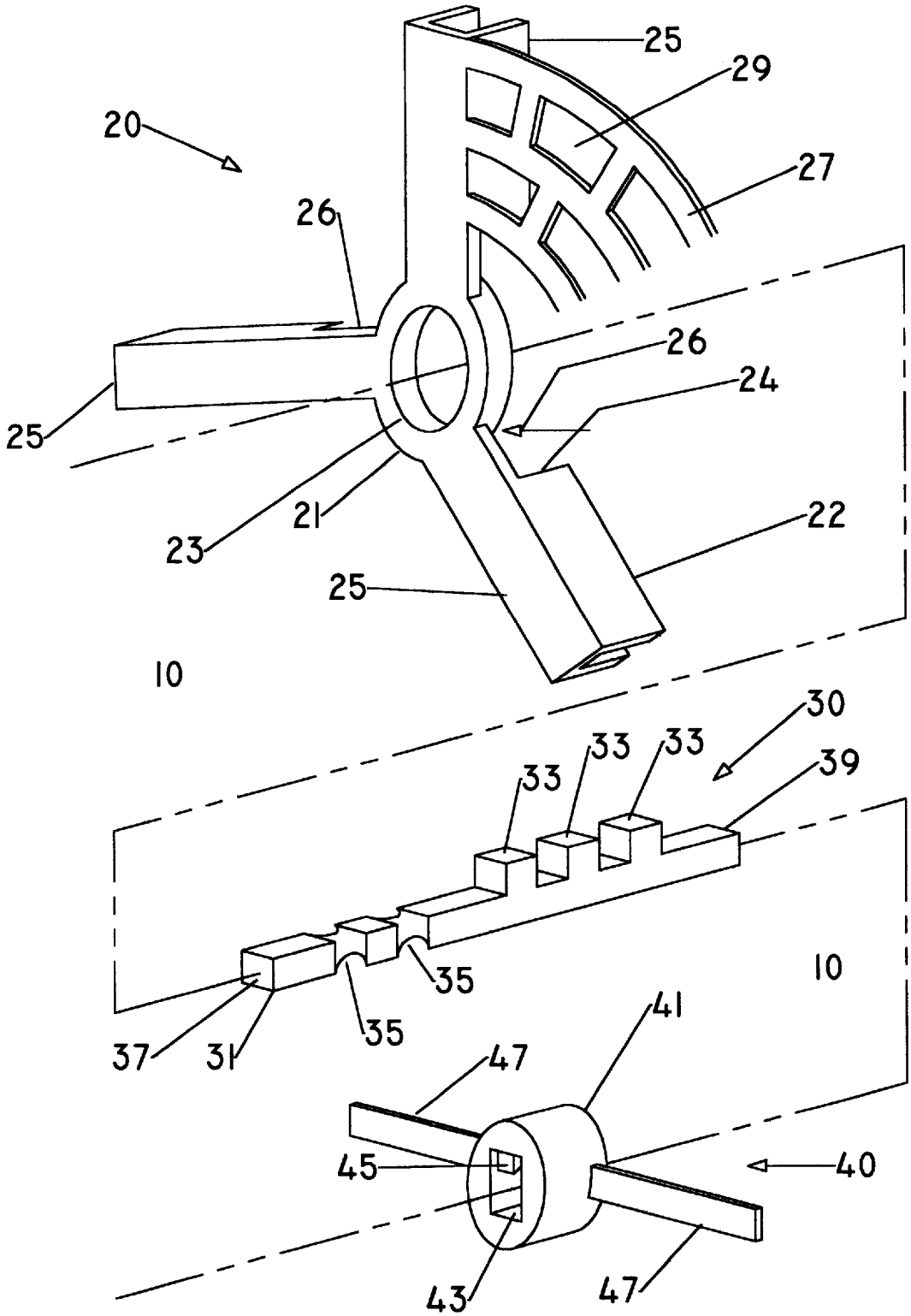
FIG. 1 is an exploded perspective diagrammatical view of a patching device according to the present invention, showing a plug, a stem, and a locking hub.

There is shown in FIG. 1 a patching device 10 comprising a plug 20, a stem 30, and locking hub 40. Plug 20 comprises a ring 21 with an axial opening 23. Although axial opening 23 is here shown as circular, other geometric shapes which allow stem 30 to pass through, can be used. Extending from ring 21 to the periphery of plug 20 are a plurality of ribs 25 flexibly attached to ring 21. In the embodiment shown, ribs 25 are generally straight but may be curved, disjoint, or spiral in shape, for example. Each rib 25 comprises a flat section 26 adjacent ring 21, and a channel section 22 comprising a U-shaped cross section. There is a shoulder 24 at the transition from flat section 26 to channel section 22. This configuration provides rigidity to rib 25 while allowing rib 25 to bend or flex at flat section 26, a feature used to advantage in the present invention, as explained in greater detail below.

In the embodiment illustrated, plug 20 is shown as comprising three ribs 25, but it should be understood that four or more ribs 25 can be used. Preferably, plug 20 further comprises a relatively thin, flexible web 27 extending between adjacent ribs 25. Web 27 comprises a plurality of web openings 29 so as to allow the collapse of web 27, and of plug 20 itself, when adjacent ribs 25 are flexed at respective flat sections 26. Preferably, web 27 comprises the same material as ribs 25 so as to provide for fabrication of plug 20 as a unitary component. For clarity of illustration, only one web 27 is shown, but it should be understood that plug 20 comprises a web 27 between two or more pairs of adjacent ribs 25.

Stem 30 comprises a rod 31 having a plurality of transverse protrusions 33 and, preferably, a plurality of necked-down regions 35. Transverse protrusions 33 may form a series of ring-like structures, as shown, or may alternatively form a helical, screw-like shape. As explained in greater detail below, transverse protrusions 33 are utilized in the assembly of patching device 10, and necked-down regions 35 provide a means of breaking off an unneeded portion of stem 30. Transverse protrusions 33 are generally grouped near a distal end 39 of rod 31 and necked-down regions 35 are generally grouped near a proximal end 37 of rod 31.

In a preferred embodiment, some of necked-down regions 35 are interposed between transverse protrusions 33 so as to allow for the breaking of stem 30 within the grouping of transverse protrusions 33, as needed. For clarity of illustration, rod 31 is here shown as having a generally rectangular cross section, but one skilled in the relative art will appreciate that the configuration of rod 31 is not so limited and may comprise another cross section meeting the above-stated criterion that stem 30 pass through axial opening 23.

Locking hub 40 comprises a pair of tabs 47 flexibly connected to a ratchet collar 41. Ratchet collar 41 comprises a locking tooth 45 protruding into a collar opening 43. Collar opening 43 has approximately the same size and cross-sectional shape as that of rod 31. Locking tooth 45 is attached to ratchet collar 41 in a cantilever configuration so as to allow transverse movement of locking tooth 45 with respect to the axis of collar opening 43. In this way, when stem 30 is inserted into collar opening 43, locking tooth 45 engages successive transverse protrusions 33 to produce a ratcheting action. Preferably, the engagement surfaces of locking tooth 45 are configured so as to allow insertion of stem 30 into collar opening 43 in a preferred direction (i.e., from distal end 39 to proximal end 37) and to restrain or prevent movement of stem 30 in the opposite direction.

Figure 2:
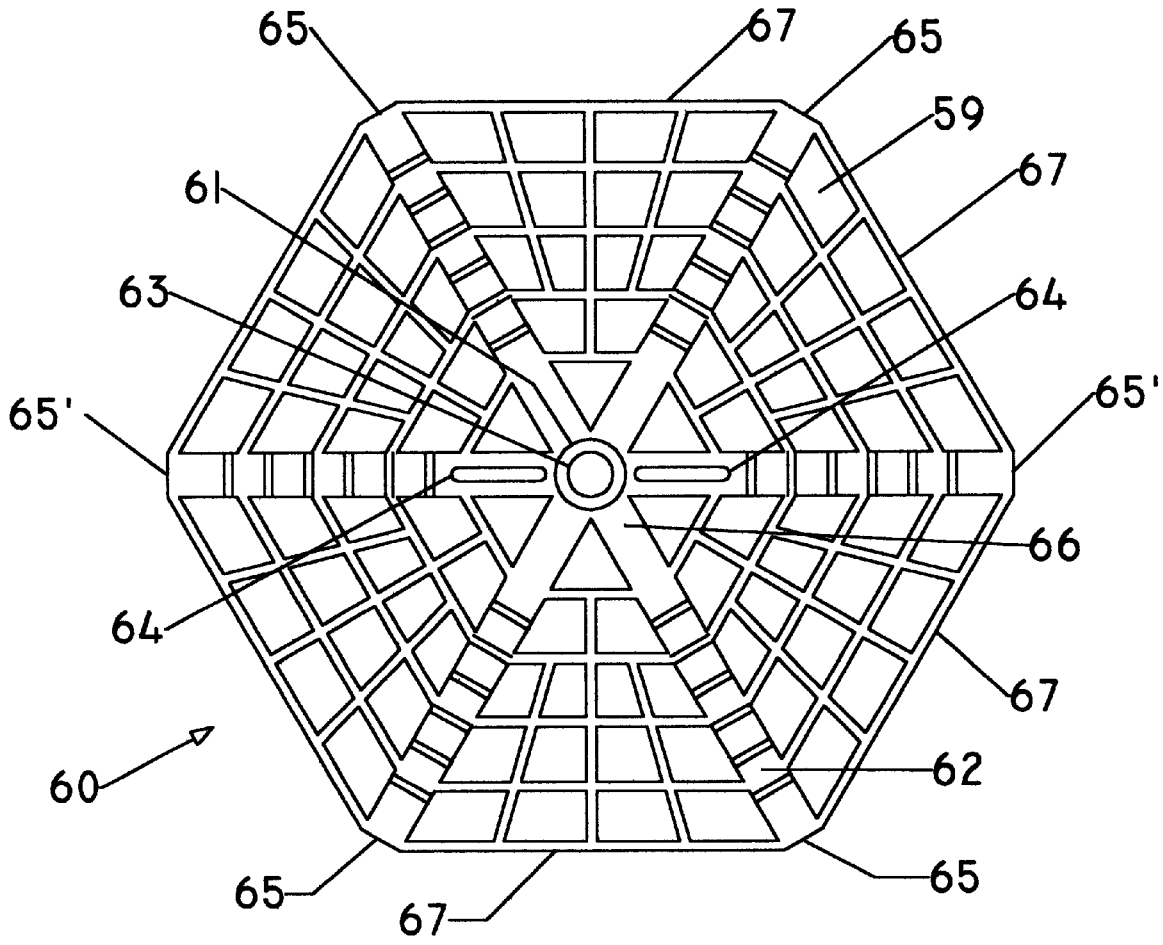
FIGS. 2 and 3 are, respectively, top and end views of a preferred embodiment of a plug according to the present invention.
Figure 3:
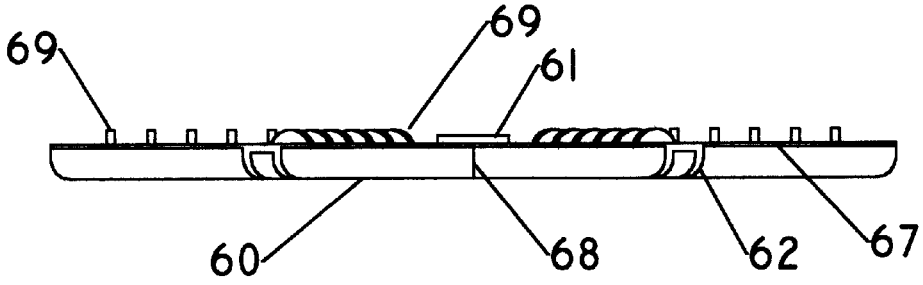

FIGS. 2 and 3 illustrate a preferred embodiment of a plug 60 in plan view and side view respectively. Plug 60 comprises four ribs 65 and two ribs 65' extending radially from a circular ring 61. Centered within ring 61 is an axial opening 63 approximately 0.028 inch in diameter. Each rib 65 and 65' comprises a short flat section 66 and a channel section 62, with a shoulder 68 formed at the transition between flat section 66 and channel section 62. Flat section 66 allows each rib 65 and 65' to flex in both directions but, upon assembly, the flexing of ribs 65 and 65' is restricted, as explained in greater detail below.

Ribs 65' also comprise a slotted opening 64. A web 67 extends between each adjacent pair of ribs 65, each web 67 comprising a plurality of web openings 59 so as to form a lattice pattern. A plurality of optional bumps 69 extend from channel sections 62 to aid in the emplacement of plug 60, as explained in greater detail below.

Plug 60 is preferably fabricated from a flexible plastic material, such as polypropylene or nylon. Such a material allows a user to significantly fold web 67, bend ribs 65 and 65', and consequently collapse plug 60 without causing breakage. The diameter of plug 60 (as measured from the tips of opposed ribs 65) is of a sufficient size to adequately cover most repair situations. It has been determined that a diameter of approximately 5.25 inch has a wide range of application. A web 67 thickness of less than 0.05 inch allow web 67 to collapse when adjacent ribs 65 are bent inwardly during emplacement of plug 60, yet is of sufficient thickness to support filler material. The thickness of ring 61 is preferably greater than that of web 67. Bumps 69 are of sufficient height so as to frictionally engage the interior surface of a repair region and prevent lateral slippage of plug 60.

Figure 4:
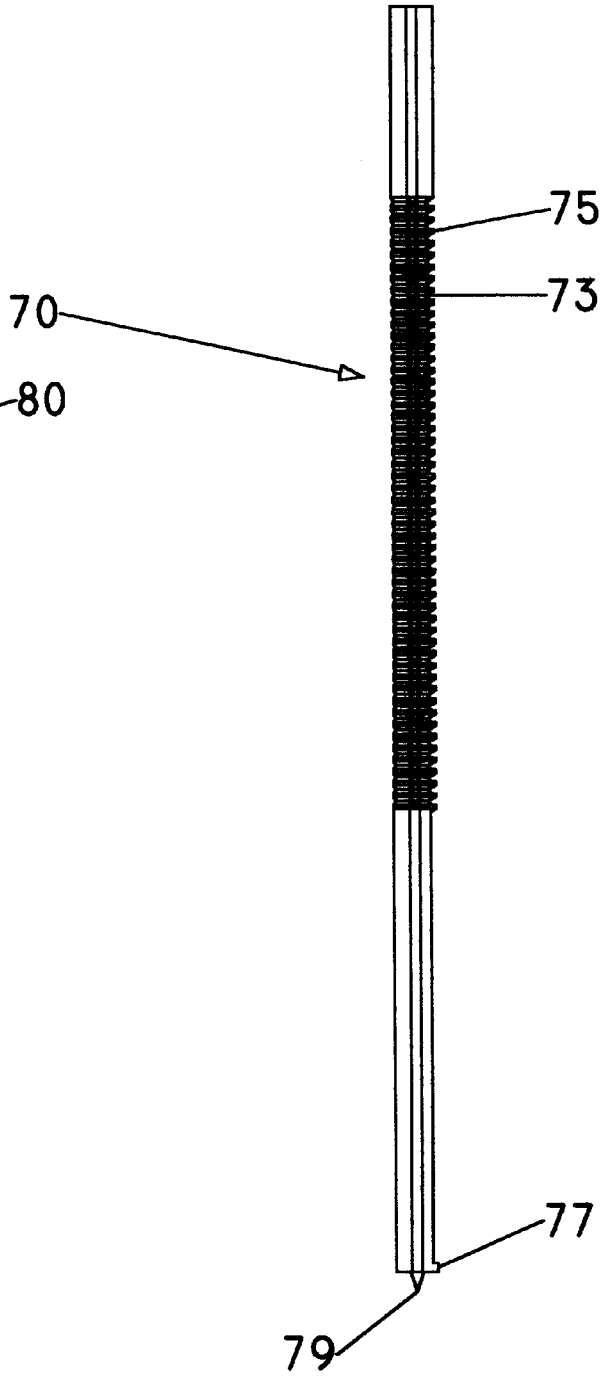
FIG. 4 shows a preferred embodiment of a stem according to the present invention.
Figure 5:
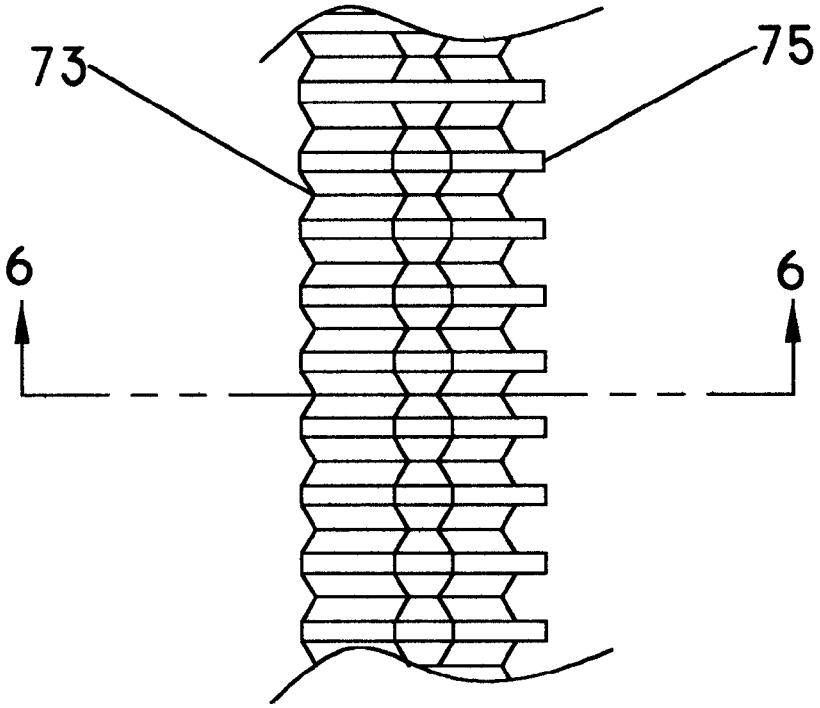
FIG. 5 is an enlarged view of a portion of the stem of FIG. 4.
Figure 6:
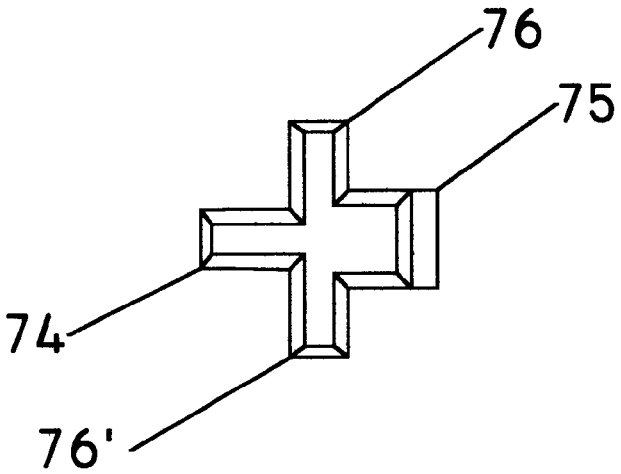
FIG. 6 is an enlarged cross-sectional view of the stem of FIG. 5 as indicated by the sectional lines in FIG. 5.

FIG. 4 illustrates a preferred embodiment of a stem 70 comprising a plurality of transverse protrusions 75 interposed between a plurality of necked-down regions 73. An engagement point 79 and a retention protrusion 77 are disposed at the distal end of stem 70. FIG. 5 is an enlarged view of a portion of stem 70, providing, in greater detail, the shapes of transverse protrusions 75 and necked-down regions 73. As best seen in FIG. 6, the cross section of stem 70 comprises transverse protrusion 75, an opposed protrusion 74, and lateral protrusions 76 and 76'. Stem 70 can be fabricated from a rigid, less flexible plastic than polypropylene, such as polystyrene, so as to aid in the breaking off of an unneeded portion of stem 70, as explained in greater detail below.

Figure 7:
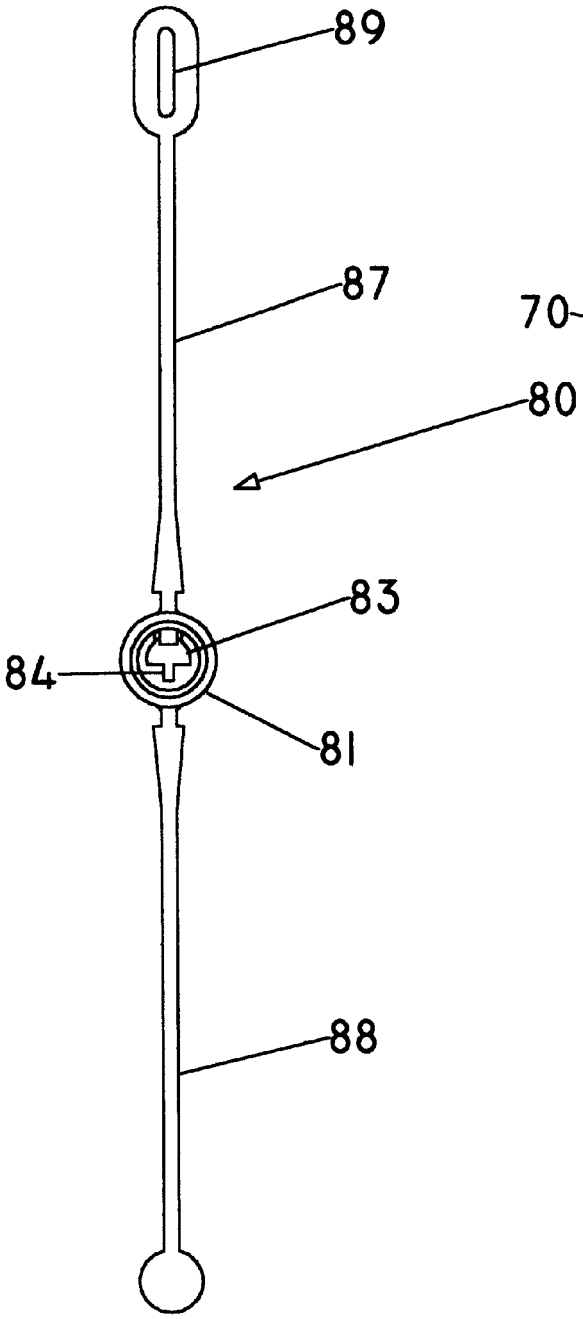
FIG. 7 shows a preferred embodiment of a locking hub comprising a ratchet collar according to the present invention.
Figure 8:
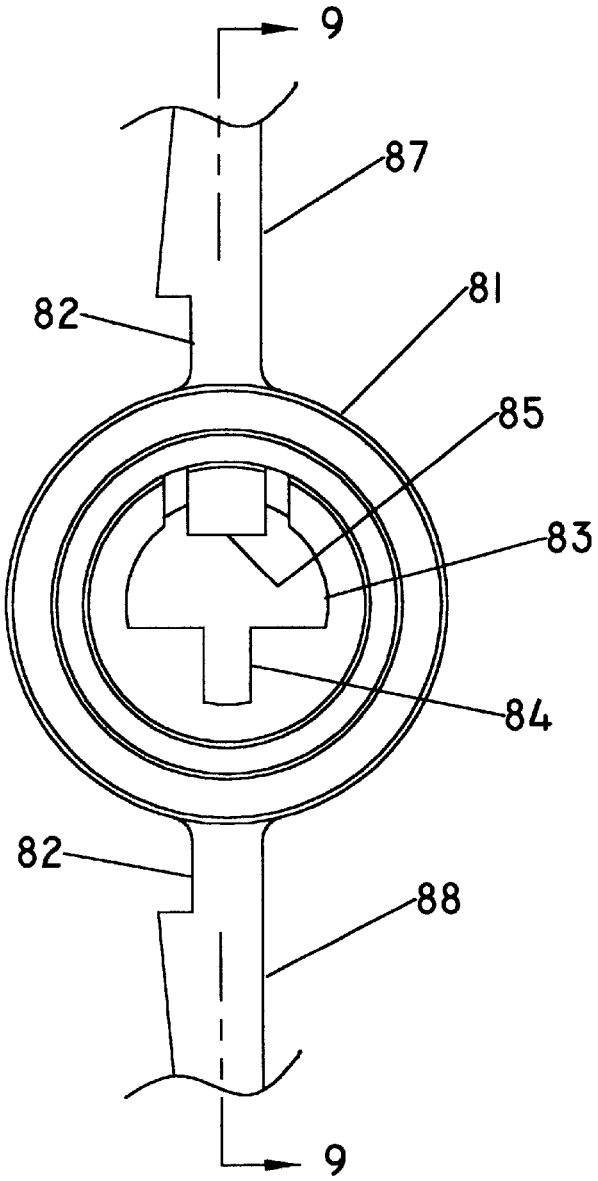
FIG. 8 is an enlarged view of the ratchet collar portion of the locking hub of FIG. 7.

FIG. 7 shows a preferred embodiment of a locking hub 80 comprising a ratchet collar 81 and tabs 87 and 88. Tab 88 is configured for insertion into a slot 89 within tab 87, as explained in greater detail below. Ratchet collar 81 comprises a collar opening 83 configured so as to allow insertion of stem 70, as seen in greater detail in FIG. 8. Collar opening 83 comprises an opposed slot 84 configured to insertably mate with opposed protrusion 74 of stem 70 (see FIG. 6). Tabs 87 and 88 each comprise one or two notches 82 for use in assembly of the patching device, as explained in greater detail below. Placement of notch 82, when only a single notch is used, can be to either side of the respective tab (cf. FIGS. 7 and 8).

Figure 9:
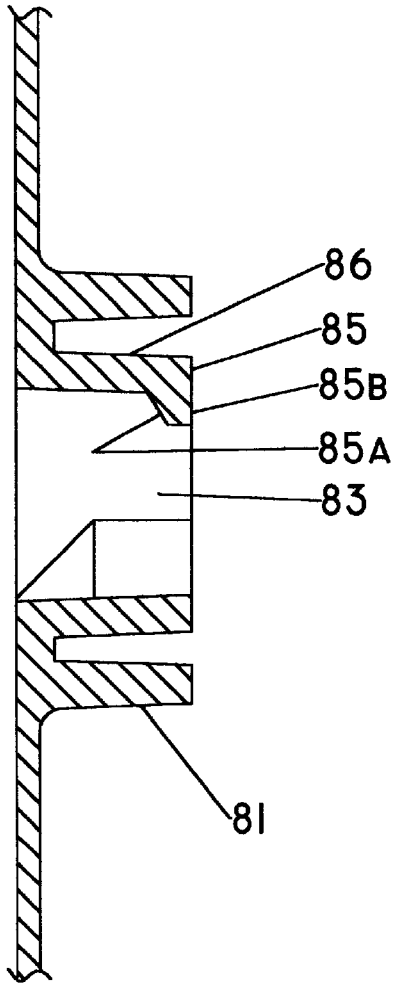
FIG. 9 is an enlarged cross-sectional view of the ratchet collar of FIG. 7 as indicated by the sectional lines in FIG. 8.

Ratchet collar 81 further comprises a locking tooth 85 configured for engagement with transverse protrusions 75 of stem 70. As best seen in the cross-sectional view of FIG. 9, locking tooth 85 is secured to ratchet collar 81 by means of a cantilever member 86 which allows locking tooth 85 to move transversely upon insertion of stem 70 into collar opening 83. Locking tooth comprises an oblique engagement surface 85*a*, configured so as to allow insertion of stem 70 in the preferred direction, and an orthogonal engagement surface 85*b*, configured so as to restrain or prevent movement of stem 70 in the opposite direction.

Figure 10:
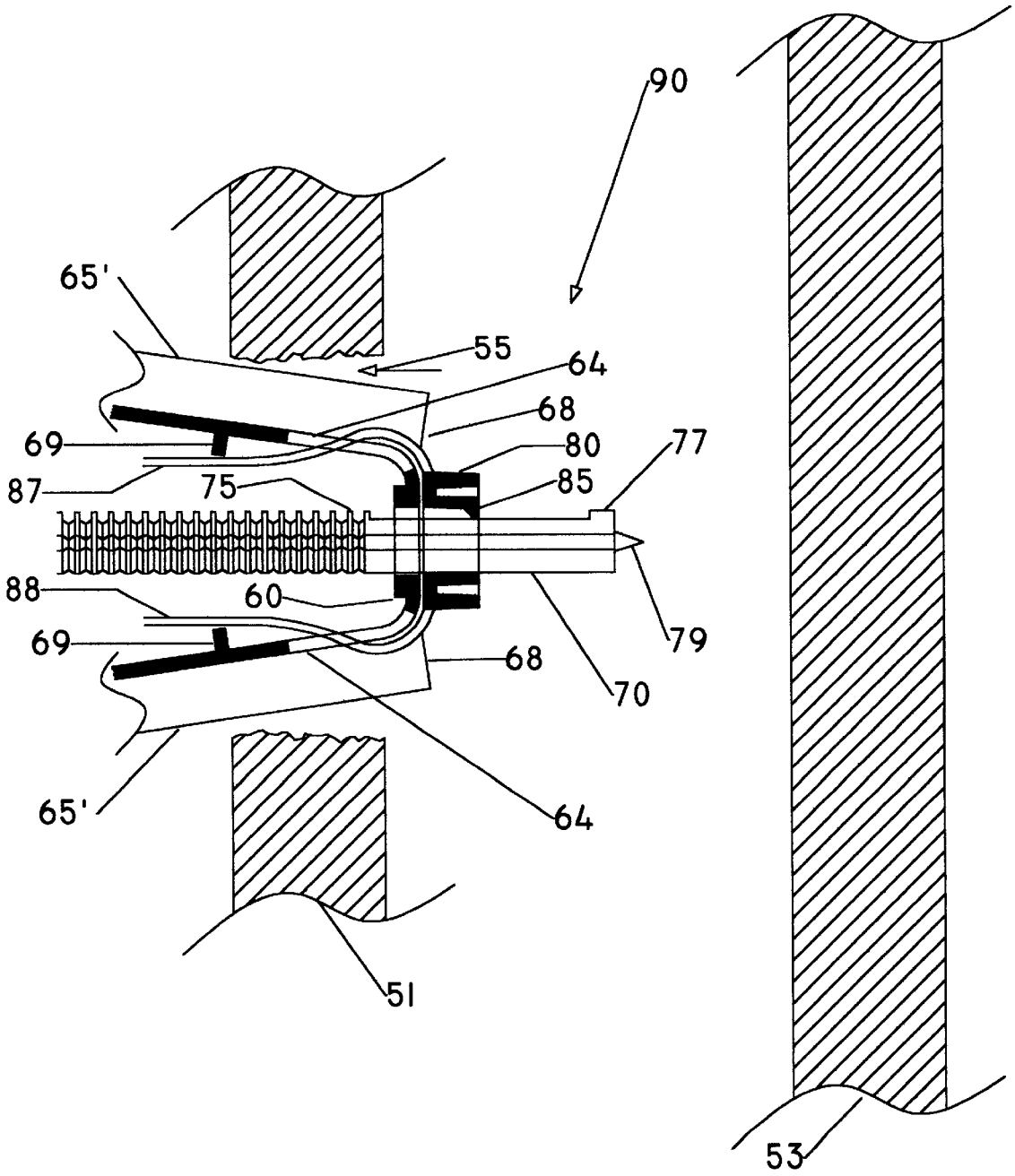
FIG. 10 is a diagrammatical side view of a patching device at an initial step in the repair of an opening in a hollow structure.
Figure 11:
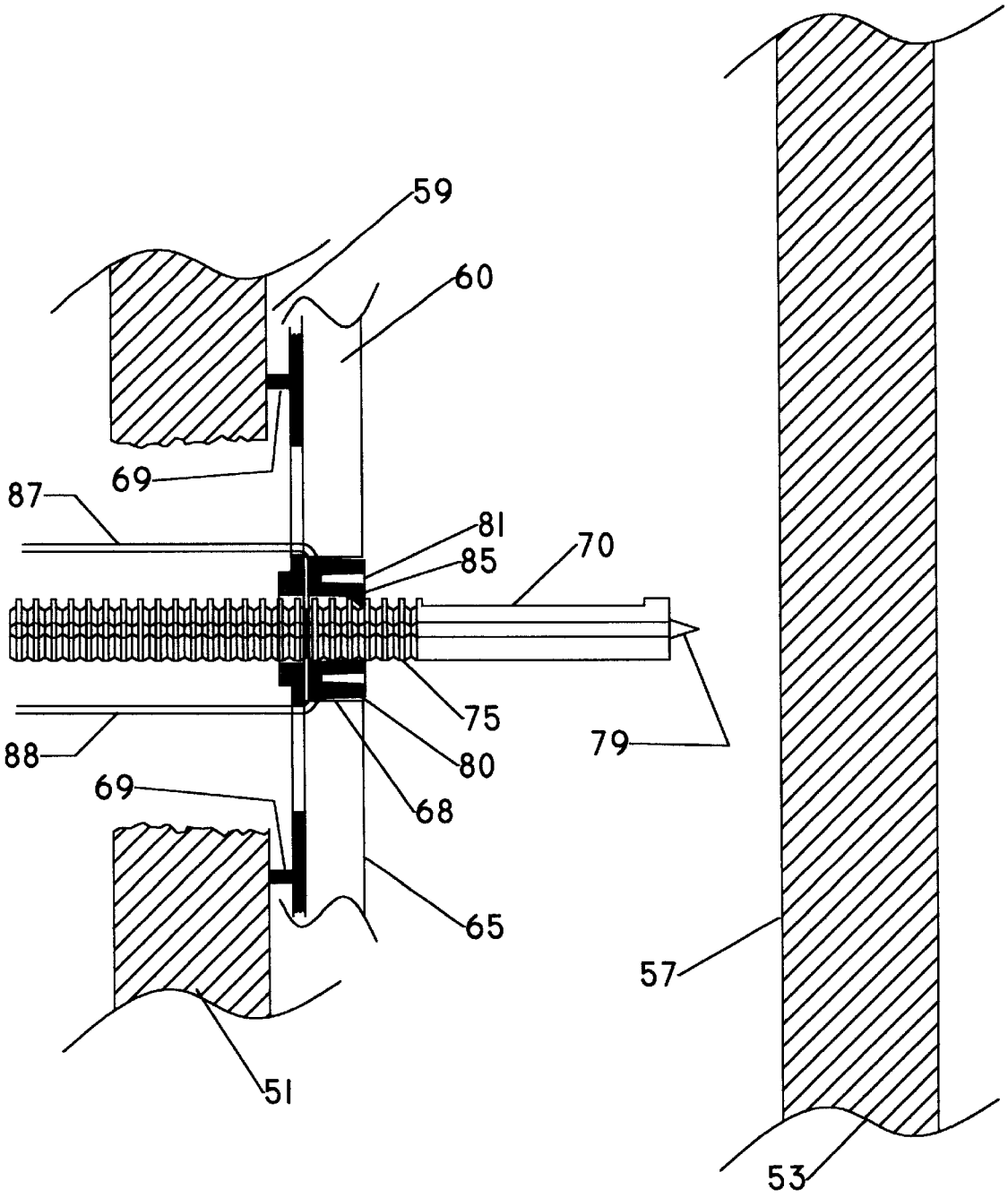
FIG. 11 is a diagrammatical side view of the patching device of FIG. 10 shown at a subsequent step.
Figure 12:
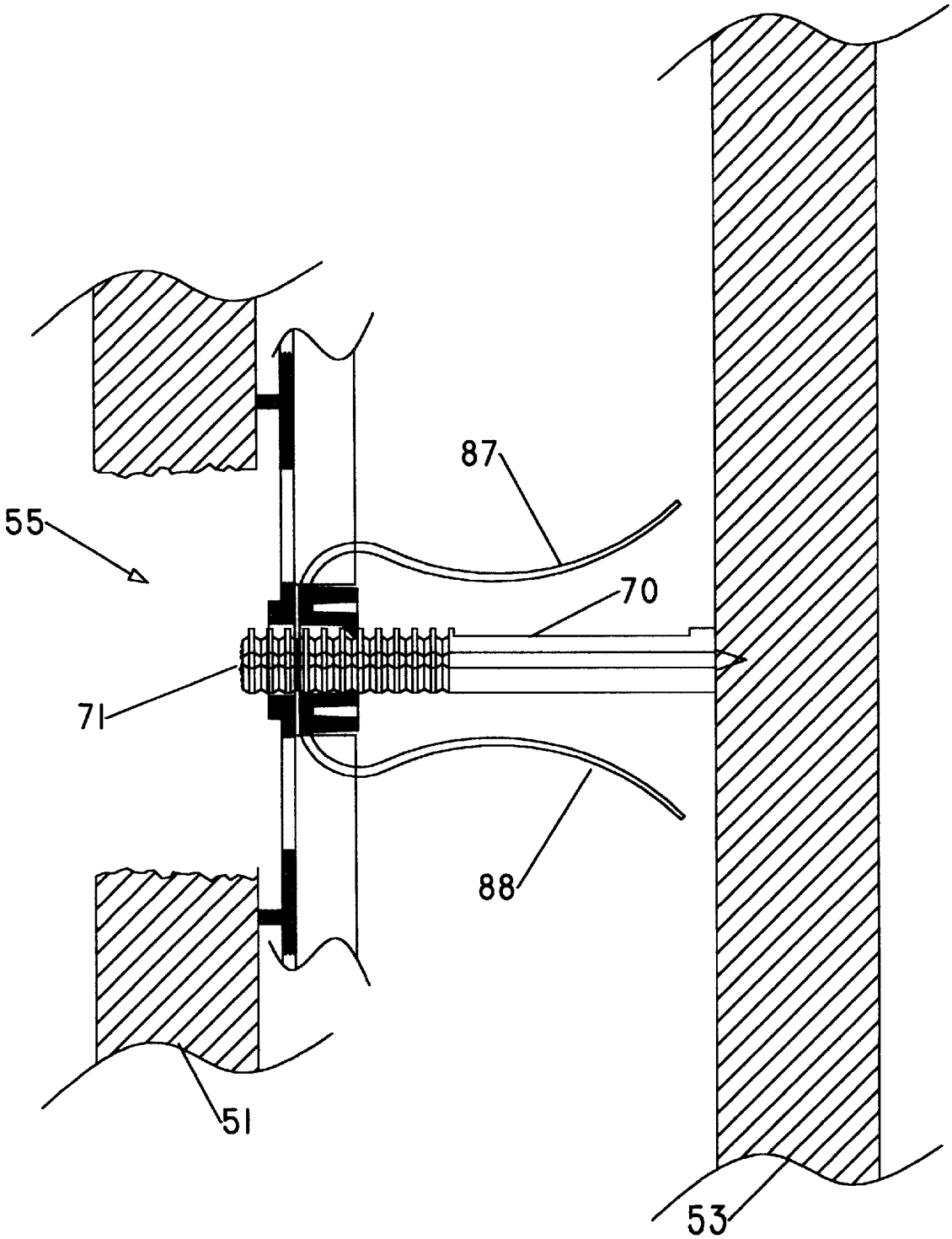
FIG. 12 is a diagrammatical side view of the completely installed patching device of FIG. 10.

FIGS. 10–12 illustrate successive steps followed in a typical application of a patching device 90, such as in the repair of a hollow structure formed by a proximal panel 51, which may be a sheet of drywall or luan, and a distal panel 53. For purpose of illustration, patching device 90 is here shown as comprising plug 60, stem 70, and locking hub 80, but it should be understood that the procedure described can be followed using any combination of alternative component embodiments described herein.

As best seen in FIG. 10, proximal panel 51 contains a break 55 which is to be repaired by utilizing patching device 90. Patching device 90 is preferably assembled prior to insertion through break 55. In assembly, plug 60 is placed over stem 70 and positioned between retention protrusion 77 and transverse protrusions 75 such that bumps 69 face transverse protrusions 75. Locking hub 80 is placed over stem 70, oriented such that locking tooth 85 allows insertion of stem 70, and positioned between plug 60 and retention protrusion 77. Tabs 87 and 88 are each inserted into a corresponding slotted opening 64 and passed through as shown. Plug 60 is collapsed by folding ribs 65 over the proximal portion of stem 70. This allows patching device 90 to be inserted through break 55 with shoulders 68 and engagement point 79 directed at distal panel 53. As can be appreciated by one skilled in the relative art, the flexing feature of ribs 65 allow plug 60 to be completely collapsed over proximal portion of stem 70 and consequently to fit into relatively small repair holes. Moreover, the rigidity of ribs 65 provided by the channel cross section enables plug 60 to cover relatively large repair openings. The features of is the present invention, thus, enable use in a wide range of repair applications.

As best seen in FIG. 11, stem 70 is inserted until engagement point 79 engages an interior surface 57 of distal panel 53. Plug 60 is opened and forced against an interior surface 59 of proximal panel 51 by pulling tabs 87 and 88 outwardly, forcing ratchet collar 81 against ring 61. This action causes shoulders 68 to engage ratchet collar 81 and bumps 69 to engage interior surface 59. As can be seen in the illustration, each shoulder 68 abuts an adjacent locking hub 80 to prevent a further cantilever flexing of corresponding rib 65 and thus maintain rib 65 against interior surface 59. Plug 60 is thus forced against interior surface 59 by ratchet collar 81 which has been pulled tight against ring 61. Ratchet collar 81 is restrained from movement across stem 70 (which would loosen the assembly) by means of the ratcheting action of locking tooth 85 when engaged with transverse protrusions 75. As plug 60 is of sufficient size so as to span break 55, plug 60 is retained in this position by means of the friction provided between bumps 69 and interior surface 59.

As best seen in FIG. 12, any unneeded portion of stem 70 is broken off to form a termination 71 so that most of what remains of patching device 90 lies inside proximal panel 51. Additionally, tabs 87 and 88 may be inserted into the space between proximal panel 51 and distal panel 53 as shown. Alternatively, tab 88 may be threaded through slot 89 (see FIG. 7) and tabs 87 and 88 left outside in break 55. Patching device now presents a surface, extending across break 55, over which filler compound may be placed so as to fill in break 55.

Figure 13:
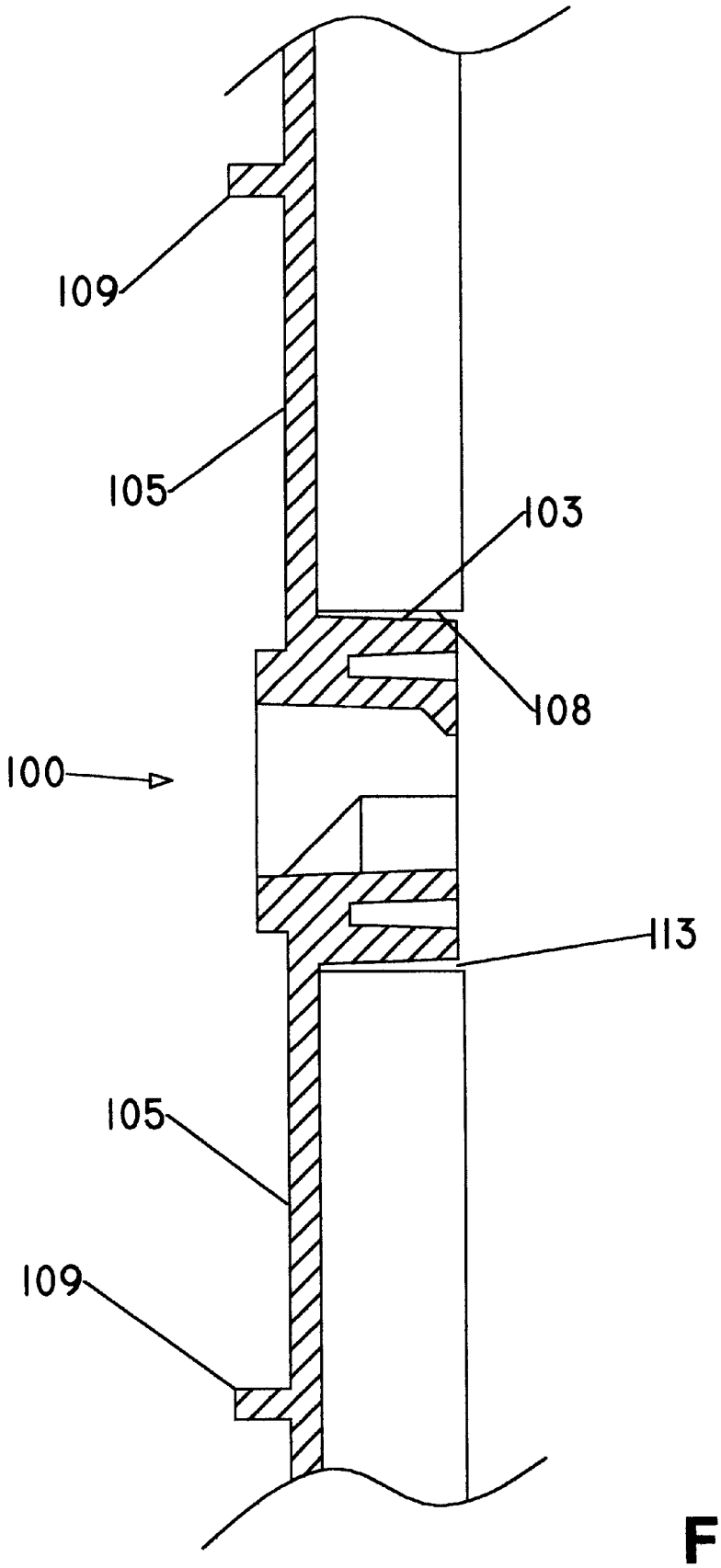
FIG. 13 is a cross-sectional view of an alternative embodiment of a unitary plug and locking hub in accordance with the present invention.

As stated above, the present invention can be practiced with a number of alternative embodiments. FIG. 13 shows, in cross section, a portion of a plug 100 comprising a plurality of bumps 109 disposed on ribs 105 extending from a central ring 101, similar to the configuration of plug 60 above. Plug 100 further comprises a ratchet collar 103, similar to ratchet collar 81, integrally formed as part of plug 100. A series of gaps 113 are formed between ratchet collar 103 and shoulders 108 of ribs 105. This feature allows ribs 105 to flex away from ratchet collar 103 when plug 100 is inserted into a repair region, and prevents ribs 105 from flexing in the opposite direction when plug 100 is extended and installed within the repair volume.

Figure 14:
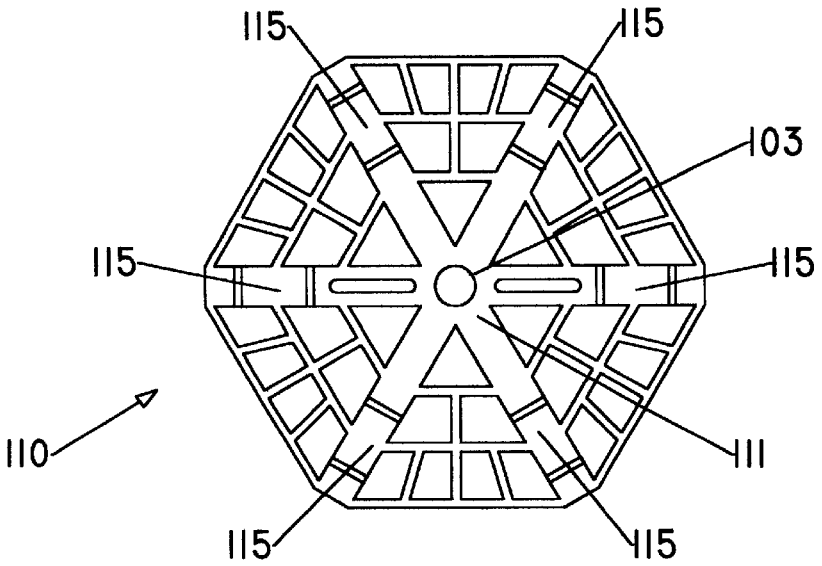
FIG. 14 is an alternative embodiment of the plug of FIG. 2 suitable for application to smaller repairs.

There is shown in FIG. 14 a smaller plug 110 comprising a central ring 111 with an axial opening 103 and six ribs 115 extending from ring 111. Plug 110 may be used in applications where a larger plug, such as plug 60 above, may not be suitable.

Figure 15:
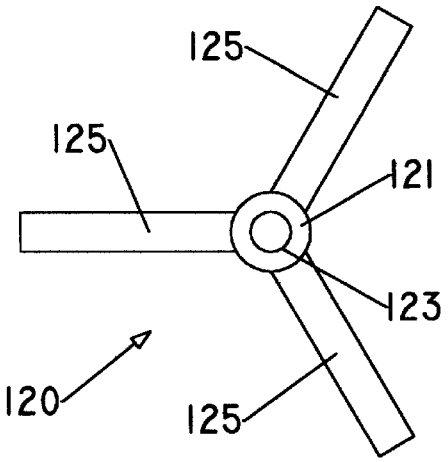
FIG. 15 is another alternative embodiment of the plug of FIG. 2 comprising a central ring and three ribs.
Figure 16:
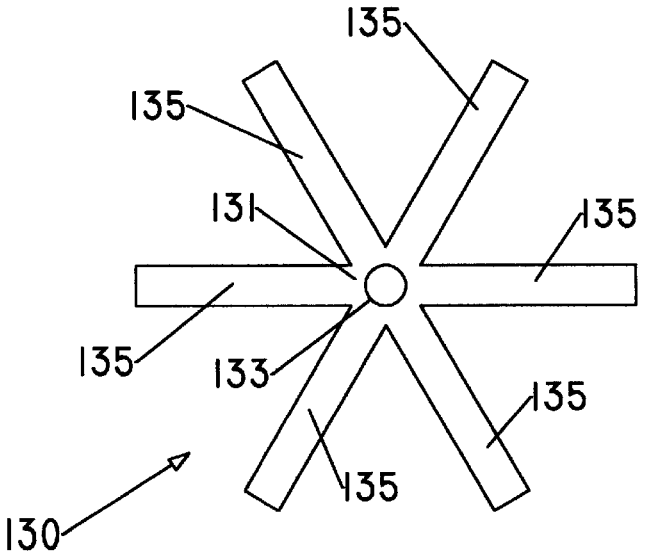
FIG. 16 is yet another alternative embodiment of the plug of FIG. 2 comprising a central ring and six ribs.

As additionally stated above, a plug need not comprise web regions. FIG. 15 shows a plug 120 comprising three ribs 125 extending from a central ring 121 with an axial opening 123. In yet another alternative embodiment, FIG. 16 shows a plug 130 comprising a central ring 131 with an axial opening 133 and six ribs 135 extending from ring 131.

Having thus described the inventive device with reference to the several embodiments, it will be understood that other modifications and variations may occur to those skilled in the art without departing from the spirit and the scope of the invention. Accordingly, the various changes in form and in detail which may be made are intended to fall within the scope of the appended claims.

What is claimed is:

1. A patching device suitable for use in the repair of a hollow structure having a distal panel disposed from a proximal repair region, said patching device comprising:

a stem comprising a proximal end, a distal end, and a plurality of transverse protrusions disposed between said proximal end and said distal end;

a plug enclosing said stem and disposed between said proximal end and said distal end, said plug comprising a ring having an axial opening of sufficient size so as to pass over said transverse protrusions, and a plurality of ribs flexibly connected to said ring and extending to the periphery of said plug, each said rib comprising a channel section having a U-shaped cross section, said channel section extending between said plug periphery and a rib shoulder; and locking means enclosing said stem and disposed between said plug and said distal end, said locking means being slideable along said stem in a preferred direction and restrained from movement in the opposite direction by said protrusions, said locking means being configured to engage said rib shoulder;

such that when said distal stem end is placed against the interior surface of the distal panel, said locking means serves to retain said plug in position across the proximal repair region.

2. A patching device as in claim 1 further comprising a web extending between at least two adjacent said ribs.

3. A patching device as in claim 1 further comprising a plurality of bumps disposed on said ribs.

4. A patching device as in claim 1 wherein said stem comprises a plurality of spaced-apart notches for use in selectively breaking off a portion of said stem.

5. A patching device as in claim 4 wherein said stem comprises a rigid plastic material so as to allow breakage of said stem at a selected said notch.

6. A patching device as in claim 1 wherein said stem comprises an engagement point for engaging the interior surface of the distal panel.

7. A patching device as in claim 1 wherein said ribs are substantially straight.

8. A patching device as in claim 1 wherein said ribs are substantially curved.

9. A patching device as in claim 1 wherein said plug comprises a flexible plastic material so as to allow said plug to be collapsed over said stem.

10. A patching device as in claim 1 wherein said rib further comprises a hinge-like flat section disposed between said ring and said channel section.

11. A patching device as in claim 10 wherein said shoulder is configured to abut said locking means for restricting the flexing of said rib.

12. A patching device as in claim 1 wherein said locking means comprises a locking tooth and spring means for producing a ratcheting action as said locking tooth is moved relative to said transverse protrusions.

13. A patching device as in claim 1 wherein said spring means comprises a cantilever spring.

14. A patching device suitable for use in the repair of a hollow structure having a distal panel disposed from a proximal repair region, said patching device comprising:

a stem comprising a proximal end, a distal end, and a plurality of transverse protrusions disposed between said proximal end and said distal end; and, a plug enclosing said stem and disposed between said proximal and distal stem ends, said plug comprising:

locking means for engaging said protrusions such that said plug is moveable along said stem from said distal end to said proximal end and is restrained from movement in the opposite direction; and a plurality of ribs flexibly connected to and extending from said locking means to the periphery of said plug, said ribs being capable of folding over onto said proximal stem end and prevented from flexing over said distal stem end such that when said distal stem end is placed against the interior surface of the distal panel, said locking means serves to retain said plug in position across the proximal repair region.

15. The patching device of claim 14 wherein said stem is substantially rod shaped and said protrusions extend outwardly from said stem.

16. A patching device as in claim 14 further comprising a web extending between at least two adjacent said ribs.

17. A patching device as in claim 14 further comprising a plurality of bumps disposed on said ribs.

18. A patching device as in claim 14 wherein said plug further comprises tabs flexibly connected to said locking means such that said plug can be urged toward said proximal stem end.

19. A method of repairing a hollow structure having a distal panel disposed from a proximal repair region, said method comprising the steps of:

placing a plug and locking means over a stem, the emplacement of said locking means along said stem comprising a ratcheting action;

collapsing said plug over a proximal portion of said stem so as to allow insertion of said plug through the repair region;

placing said stem, said locking means, and said plug inside the hollow structure;

unfolding said plug to engage said locking means, after said step of placement inside the hollow structure, such that said locking means prevents said plug from further unfolding, said plug thus deployed to span said repair region; and, forcing said locking means against said plug, after said step of unfolding, whereby said plug is frictionally retained in position against said repair region.

20. The method of claim 19 further comprising the step of breaking off a portion of said stem after said step of forcing said locking means.

* * * * *